US007861790B2

(12) United States Patent
Lembcke et al.

(10) Patent No.: US 7,861,790 B2
(45) **Date of Patent: *Jan. 4, 2011**

(54) INJECTION VALVE AND METHOD

(75) Inventors: Jeffrey John Lembcke, Cypress, TX (US); Robert J. Coon, Missouri City, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/234,184

(22) Filed: Sep. 19, 2008

(65) Prior Publication Data

US 2009/0014183 A1 Jan. 15, 2009

Related U.S. Application Data

(63) Continuation of application No. 11/468,631, filed on Aug. 30, 2006, now Pat. No. 7,455,116, which is a continuation-in-part of application No. 11/263,753, filed on Oct. 31, 2005, now abandoned.

(51) Int. Cl.
*E21B 43/12* (2006.01)

(52) U.S. Cl. ..... 166/374; 166/386; 166/321; 166/332.8

(58) Field of Classification Search ..... 166/319, 166/321, 325, 332.8, 374, 386; 137/512.1
See application file for complete search history.

(56) References Cited

U.S. PATENT DOCUMENTS 2,831,499 A * 4/1958 Myron ..... 137/512.1
2,921,601 A 1/1960 Fisher, Jr.
2,976,882 A * 3/1961 Cowan ..... 137/512.1
3,084,898 A * 4/1963 Miller ..... 251/1.1
4,151,875 A * 5/1979 Sullaway ..... 166/126
4,601,342 A * 7/1986 Pringle ..... 166/323
4,688,593 A * 8/1987 Pringle et al. ..... 137/115.08

(Continued)

FOREIGN PATENT DOCUMENTS

GB 1031139 5/1966

OTHER PUBLICATIONS

GB Examination Report for Application No. GB0621713.7 dated Nov. 13, 2009.
Canadian Office Action for Application No. 2,599,073 dated Apr. 22, 2010.
GB Search and Examination Report for GB Application No. GB1017328.4 dated Oct. 28, 2010.

*Primary Examiner*—David J Bagnell
*Assistant Examiner*—David Andrews
(74) *Attorney, Agent, or Firm*—Patterson & Sheridan, L.L.P.

(57) ABSTRACT

The present invention generally relates to controlling the flow of fluids in a wellbore. In one aspect, a valve for selectively closing a flow path through a wellbore in a first direction is provided. The valve includes a body and a piston surface formable across the flow path in the first direction. The piston surface is formed at an end of a shiftable member annularly disposed in the body. The valve further includes a flapper member, the flapper member closable to seal the flow path when the shiftable member moves from a first position to a second position due to fluid flow acting on the piston surface. In another aspect, a valve for selectively closing a flow path through a wellbore in a single direction is provided. In yet another aspect, a method for selectively closing a flow path through a wellbore in a first direction is provided.

26 Claims, 5 Drawing Sheets

U.S. PATENT DOCUMENTS 5,628,792 A * 5/1997 Lentell ..... 623/2.12
7,455,116 B2 * 11/2008 Lembcke et al. ..... 166/374
2007/0181312 A1 * 8/2007 Kritzler et al. ..... 166/372

* cited by examiner

INJECTION VALVE AND METHOD

CROSS-REFERENCE TO RELATED APPLICATIONS

This application is a continuation of U.S. patent application Ser. No. 11/468,631, filed Aug. 30, 2006, now U.S. Pat. No. 7,455,116 which is continuation-in-part of U.S. patent application Ser. No. 11/263,753, filed Oct. 31, 2005 now abandoned, which is herein incorporated by reference.

BACKGROUND OF THE INVENTION

1. Field of the Invention

Embodiments of the present invention generally relate to controlling the flow of fluids and gases in a wellbore. More particularly, the present invention relates to a valve for selectively closing a flow path in a single direction.

2. Description of the Related Art

Generally, a completion string may be positioned in a well to produce fluids from one or more formation zones. Completion devices may include casing, tubing, packers, valves, pumps, sand control equipment, and other equipment to control the production of hydrocarbons. During production, fluid flows from a reservoir through perforations and casing openings into the wellbore and up a production tubing to the surface. The reservoir may be at a sufficiently high pressure such that natural flow may occur despite the presence of opposing pressure from the fluid column present in the production tubing. However, over the life of a reservoir, pressure declines may be experienced as the reservoir becomes depleted. When the pressure of the reservoir is insufficient for natural flow, artificial lift systems may be used to enhance production. Various artificial lift mechanisms may include pumps, gas lift mechanisms, and other mechanisms. One type of pump is the electrical submersible pump (ESP).

An ESP normally has a centrifugal pump with a large number of stages of impellers and diffusers. The pump is driven by a downhole motor, which is typically a large three-phase AC motor. A seal section separates the motor from the pump for equalizing internal pressure of lubricant within the motor to that of the well bore. Often, additional components may be included, such as a gas separator, a sand separator, and a pressure and temperature measuring module. Large ESP assemblies may exceed 100 feet in length.

The ESP is typically installed by securing it to a string of production tubing and lowering the ESP assembly into the well. The string of production tubing may be made up of sections of pipe, each being about 30 feet in length.

If the ESP fails, the ESP may need to be removed from the wellbore for repair at the surface. Such repair may take an extended amount of time, e.g., days or weeks. Typically, a conventional check valve is positioned below the ESP to control the flow of fluid in the wellbore while the ESP is being repaired. The check valve generally includes a seat and a ball, whereby the ball moves off the seat when the valve is open to allow formation fluid to move toward the surface of the wellbore and the ball contacts and creates a seal with the seat when the valve is closed to restrict the flow of formation fluid in the wellbore.

Gas lift is another process used to artificially lift oil or water from wells where there is insufficient reservoir pressure to produce the well. The process involves injecting gas through the tubing-casing annulus. Injected gas aerates the fluid to make it less dense; the formation pressure is then able to lift the oil column and forces the fluid out of the wellbore. Gas may be injected continuously or intermittently, depending on the producing characteristics of the well and the arrangement of the gas-lift equipment.

The amount of gas to be injected to maximize oil production varies based on well conditions and geometries. Too much or too little injected gas will result in less than maximum production. Generally, the optimal amount of injected gas is determined by well tests, where the rate of injection is varied and liquid production (oil and perhaps water) is measured.

Although the gas is recovered from the oil at a later separation stage, the process requires energy to drive a compressor in order to raise the pressure of the gas to a level where it can be re-injected.

The gas-lift mandrel is a device installed in the tubing string of a gas-lift well onto which or into which a gas-lift valve is fitted. There are two common types of mandrel. In the conventional gas-lift mandrel, the gas-lift valve is installed as the tubing is placed in the well. Thus, to replace or repair the valve, the tubing string must be pulled. In the "sidepocket" mandrel, however, the valve is installed and removed by wireline while the mandrel is still in the well, eliminating the need to pull the tubing to repair or replace the valve.

Like other valves discussed herein, gas lift valves are typically "one way" valves and rely on a check valve to prevent gas from traveling back into the annulus once it is injected into a tubing string.

Although the conventional check valve is capable of preventing the flow of fluid in a single direction, there are several problems in using the conventional check valve in this type of arrangement. First, the seat of the check valve has a smaller inner diameter than the bore of the production tubing, thereby restricting the flow of fluid through the production tubing. Second, the ball of the check valve is always in the flow path of the formation fluid exiting the wellbore which results in the erosion of the ball. This erosion may affect the ability of the ball to interact with the seat to close the valve and restrict the flow of fluid in the wellbore.

Therefore, a need exists in the art for an improved apparatus and method for controlling the flow of fluid and gas in a wellbore.

SUMMARY OF THE INVENTION

The present invention generally relates to controlling the flow of fluids and gases in a wellbore. In one aspect, a valve for selectively closing a flow path in a first direction is provided. The valve includes a body and a piston surface formable across the flow path in the first direction. The piston surface is formed at an end of a shiftable member annularly disposed in the body. The valve further includes a flapper member, the flapper member closable to seal the flow path when the shiftable member moves from a first position to a second position due to fluid flow acting on the piston surface.

In another aspect, a valve for selectively closing a flow path through a wellbore in a single direction is provided. The valve includes a housing and a variable piston surface area formable across the flow path in the single direction. The valve also includes a flow tube axially movable within the housing between a first and a second position, wherein the variable piston surface is operatively attached to the flow tube. Further, the valve includes a flapper for closing the flow path through the valve upon movement of the flow tube to the second position.

In yet another aspect, a method for selectively closing a flow path through a wellbore in a first direction is provided. The method includes positioning a valve in the wellbore, wherein the valve has a body, a formable piston surface at an end of a shiftable member, and a flapper member. The method further includes reducing the flow in the first direction, thereby forming the piston surface. Further, the method includes commencing a flow in a second direction against the piston surface to move the shiftable member away from a position adjacent the flapper member. Additionally, the method includes closing the flapper member to seal the flow path through the wellbore.

In another embodiment, a valve embodying aspects of the invention is used in a gas lift arrangement to prevent the back flow of oil or gas injected into a tubing string from an annular area while reducing any obstruction of flow through the gas lift apparatus.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
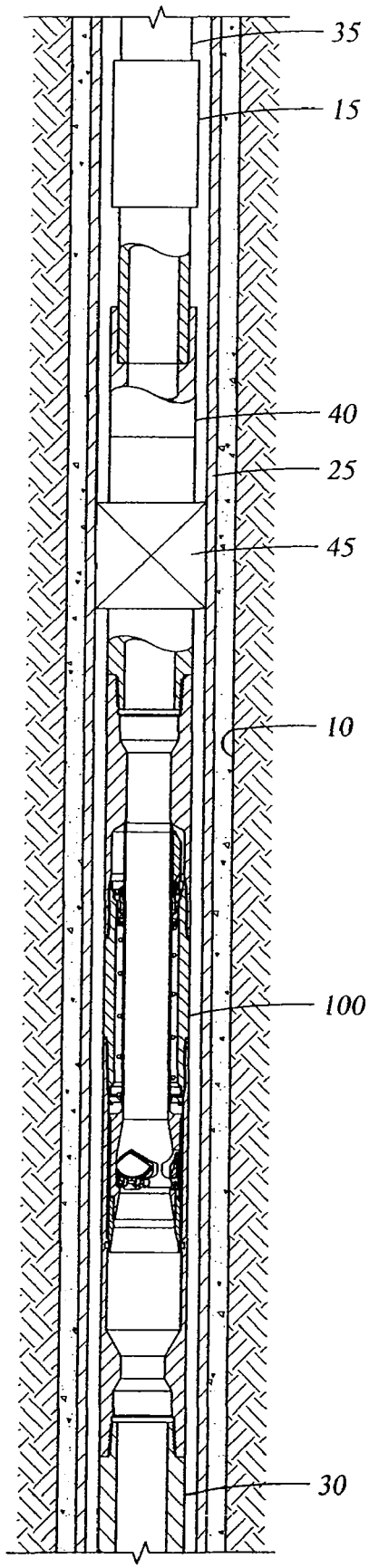
FIG. 1 is a view illustrating a control valve disposed in a wellbore.

FIG. 1 is a view illustrating a control valve 100 disposed in a wellbore 10. As shown, the control valve 100 is in a lower completion assembly disposed in a string of tubulars 30 inside a casing 25. An electrical submersible pump 15 may be disposed above the control valve 100 in an upper completion assembly. As illustrated, a polished bore receptacle and seal assembly 40 may be used to interconnect the electrical submersible pump 15 to the valve 100 and a packer arrangement 45 may be used to seal an annulus formed between the valve 100 and the casing 25. Generally, the valve 100 is used to isolate the lower completion assembly from the upper completion assembly when a mechanism in the upper completion assembly, such as the pump 15, requires modification or removal from the wellbore 10.

The electrical submersible pump 15 serves as an artificial lift mechanism, driving production fluids from the bottom of the wellbore 10 through production tubing 35 to the surface. Although embodiments of the invention are described with reference to an electrical submersible pump, other embodiments contemplate the use of other types of artificial lift mechanisms commonly known by persons of ordinary skill in the art. Further, the valve 100 may be used in conjunction with other types of downhole tools without departing from principles of the present invention.

Figure 2:
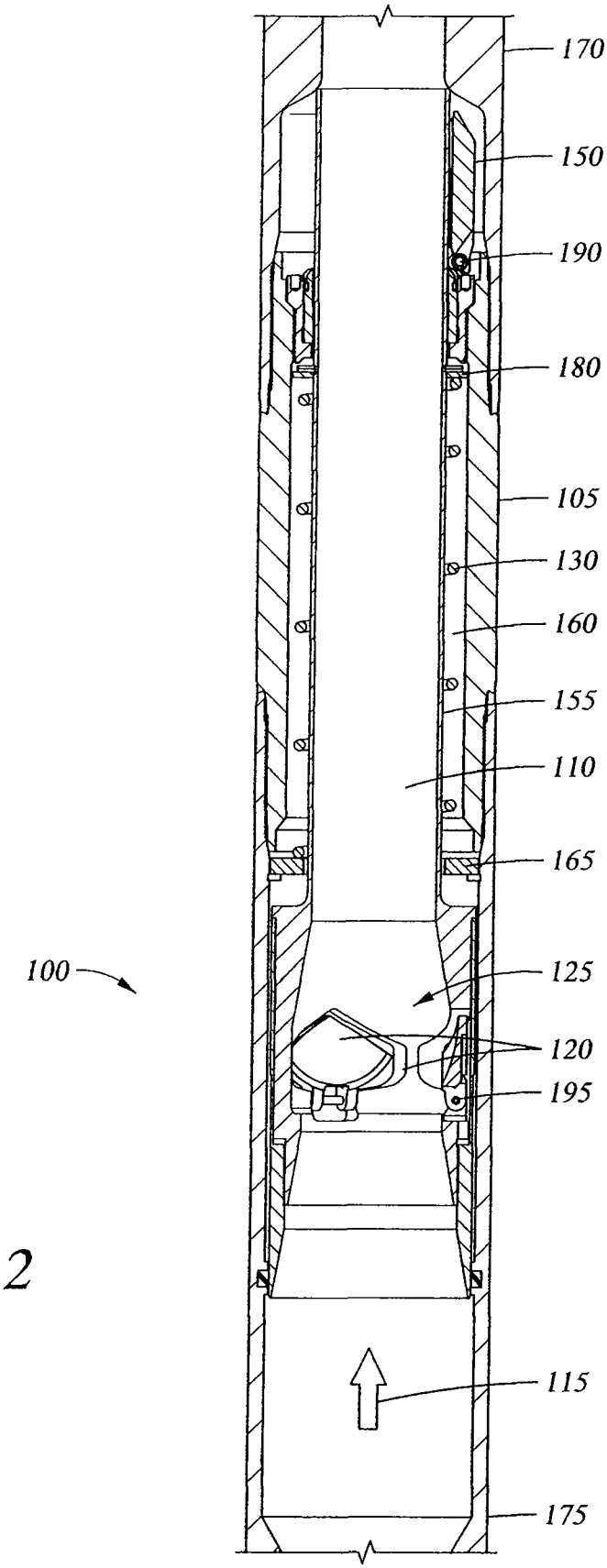
FIG. 2 is a view illustrating the valve in an open position.

FIG. 2 is a view of the valve 100 in an open position. The valve 100 includes a top sub 170 and a bottom sub 175. The top 170 and bottom 175 subs are configured to be threadedly connected in series with the other downhole tubing. The valve 100 further includes a housing 105 disposed intermediate the top 170 and bottom 175 subs. The housing 105 defines a tubular body that serves as a housing for the valve 100. Additionally, the valve 100 includes a bore 110 to allow fluid, such as hydrocarbons, to flow through the valve 100 during a production operation.

The valve 100 includes a piston surface 125 that is formable in the bore 110 of the valve 100. The piston surface 125 shown in FIG. 2 is in an unformed state. The piston surface 125 is maintained in the unformed state by a fluid force acting on the piston surface 125 created by fluid flow through the bore 110 of the valve 100 in the direction indicated by arrow 115. The piston surface 125 generally includes three individual members 120. Each member 120 has an end that is rotationally attached to a flow tube 155 by a pin 195 and each member 120 is biased rotationally inward toward the center of the valve 100. Additionally, each member 120 is made from a material that is capable of withstanding the downhole environment, such as a metallic material or a composite material. Optionally, the members 120 may be coated with an abrasion resistant material.

As illustrated in FIG. 2, the valve 100 also may include a biasing member 130. In one embodiment, the biasing member 130 defines a spring. The biasing member 130 resides in a chamber 160 defined between the flow tube 155 and the housing 105. A lower end of the biasing member 130 abuts a spring spacer 165. An upper end of the biasing member 130 abuts a shoulder 180 formed on the flow tube 155. The biasing member 130 operates in compression to bias the flow tube 155 in a first position. Movement of the flow tube 155 from the first position to a second position compresses the biasing member 130 against the spring spacer 165.

The valve 100 further includes a flapper member 150 configured to seal the bore 110 of the valve 100. The flapper member 150 is rotationally attached by a pin 190 to a portion of the housing 105. The flapper member 150 pivots between an open position and a closed position in response to movement of the flow tube 155. In the open position, a fluid pathway is created through the bore 110, thereby allowing the flow of fluid through the valve 100. Conversely, in the closed position, the flapper member 150 blocks the fluid pathway through the bore 110, thereby preventing the flow of fluid through the valve 100.

As shown in FIG. 2, a upper portion of the flow tube 155 is disposed adjacent the flapper member 150. The flow tube 155 is movable longitudinally along the bore 110 of the valve 100 in response to a force on the piston surface 125. Axial movement of the flow tube 155, in turn, causes the flapper member 150 to pivot between its open and closed positions. In the open position, the flow tube 155 blocks the movement of the flapper member 150, thereby causing the flapper member 150 to be maintained in the open position. In the closed position, the flow tube 155 allows the flapper 150 to rotate on the pin 190 and move to the closed position. It should also be noted that the flow tube 155 substantially eliminates the potential of contaminants from interfering with the critical workings of the valve 100.

Figure 4:
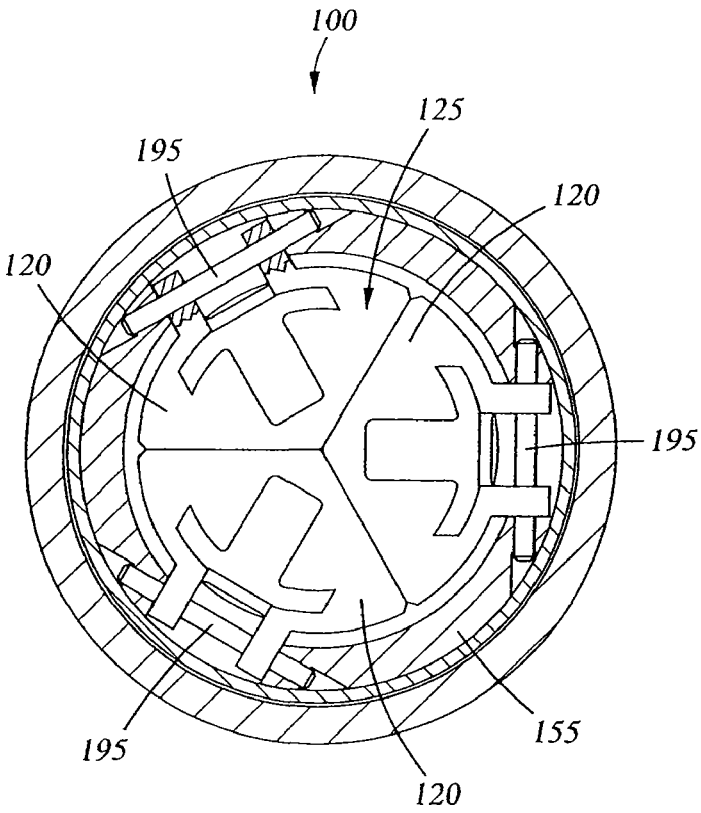
FIG. 4 is a view taken along line 4-4 of FIG. 3 to illustrate the piston surface.
Figure 3:
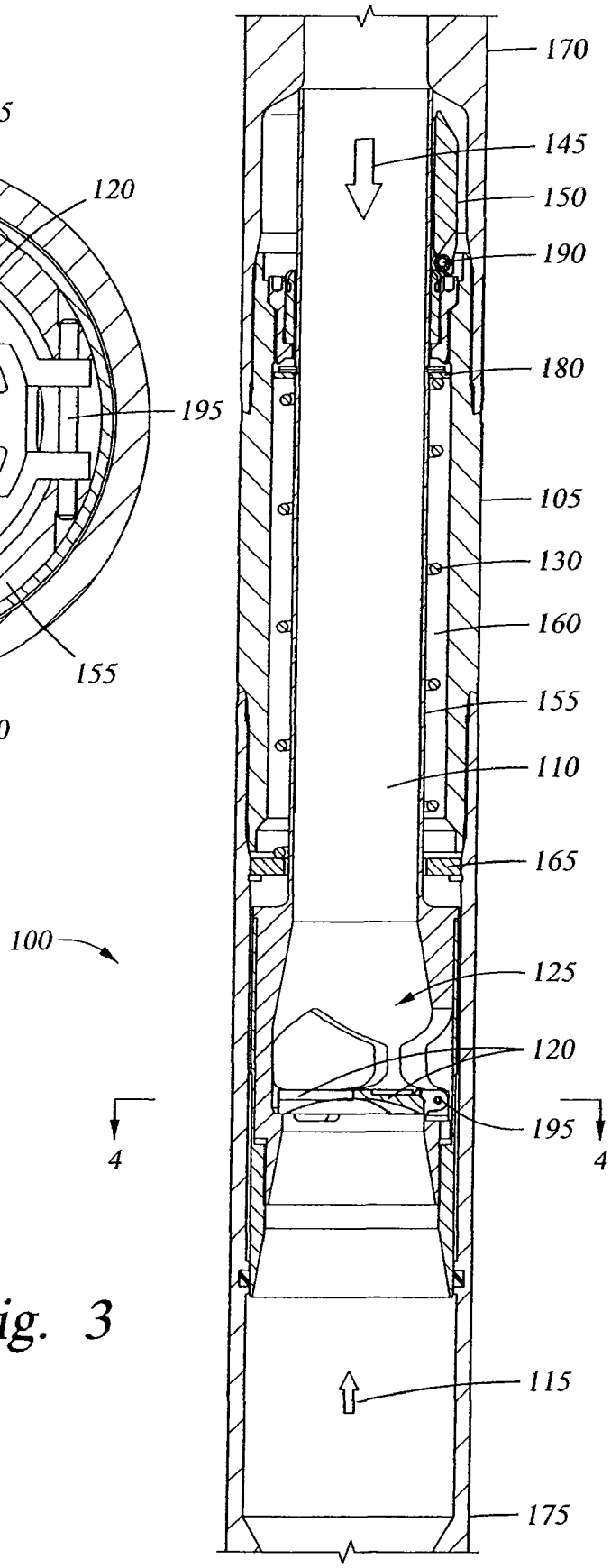
FIG. 3 is a view illustrating the piston surface formed in a bore of the valve.

FIG. 3 illustrates the piston surface 125 formed in the bore of the valve 100. To seal the bore 110, the flow of fluid through the bore 110 of the valve 100 in the direction indicated by the arrow 115 is reduced. As the flow of fluid is reduced, the fluid force holding the piston surface 125 in the unformed state becomes less than the biasing force on the piston surface 125. At that point, each member 120 of the piston surface 125 rotates around the pin 195 toward the center of the valve 100 to form the piston surface 125 illustrated in FIG. 4. After the piston surface 125 is formed, the flow of fluid in the direction indicated by arrow 145 is commenced, thereby creating a force on the piston surface 125. As the force on the piston surface 125 increases, the force eventually becomes stronger than the force created by the biasing member 130. At that point, the force on the piston surface 125 urges the flow tube 155 longitudinally along the bore 110 of the valve 100.

Figure 5:
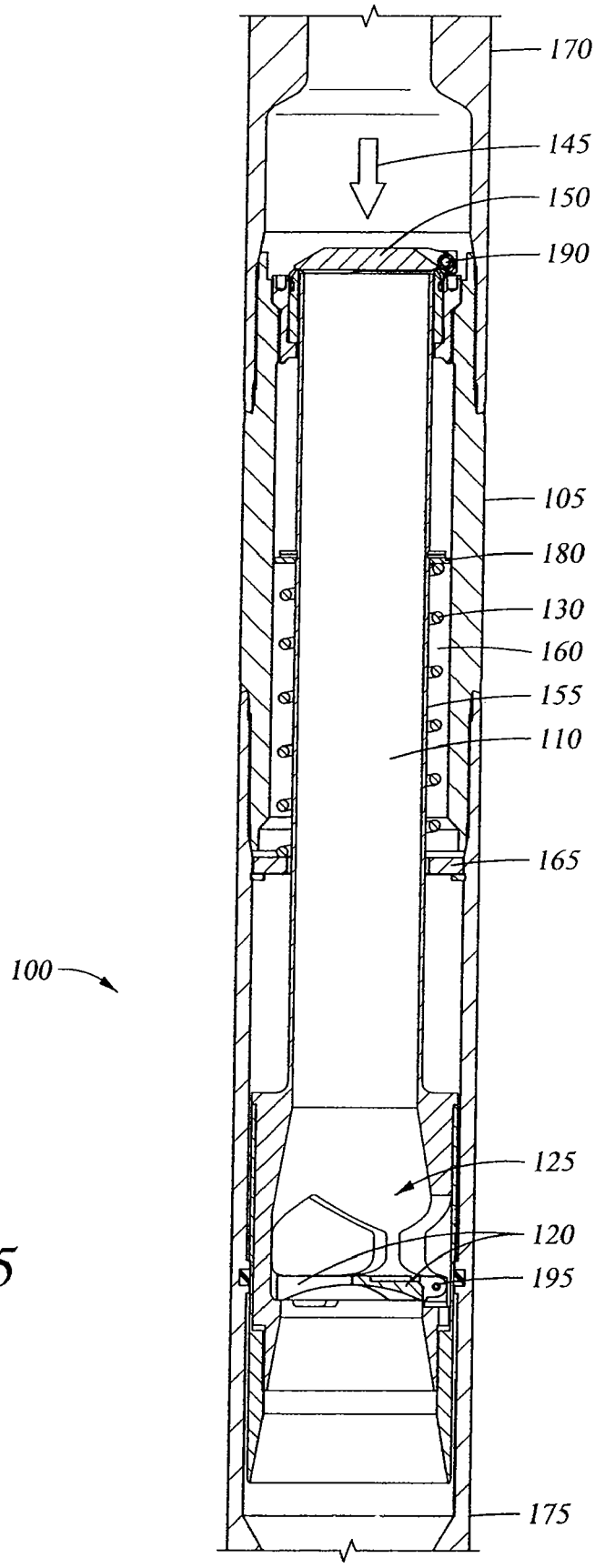
FIG. 5 is a view illustrating the valve in the closed position.

FIG. 5 is a view illustrating the valve 100 in the closed position. After the piston surface 125 is formed, the flow tube 155 moves axially in the valve 100. This moves the upper end of the flow tube 155 out of its position adjacent the flapper member 150. This, in turn, allows the flapper member 150 to pivot into its closed position. In this position, the bore 110 of the valve 100 is sealed, thereby preventing fluid communication through the valve 100. More specifically, flow tube 155 in the closed position no longer blocks the movement of the flapper member 150, thereby allowing the flapper member 150 to pivot from the open position to the closed position and seal the bore 110 of the valve 100.

The flapper member 150 in the closed position closes the flow of fluid through the bore 110 of the valve 100, therefore no fluid force in the bore 110 acts on the members 120. To move the flapper member 150 back to the open position, the flow of fluid in the direction indicated by arrow 145 is reduced and the fluid on top of the flapper member 150 is pumped or sucked off the top of the flapper member 150. At a predetermined point, the biasing member biasing the flapper member 150 is overcome and subsequently the biasing member 130 extends axially to urge the flow tube 155 longitudinally along the bore 110 until a portion of the flow tube 155 is adjacent the flapper member 150. In this manner, the flapper member 150 is back to the open position, thereby opening the bore 110 of the valve 100 to flow of fluid therethrough, as illustrated in FIG. 2.

In one embodiment, the valve 100 may be locked in the open position as shown in FIG. 2 by disposing a tube (not shown) in the bore 110 of valve 100. The tube is configured to prevent the axial movement of flow tube 155 from the first position to the second position by preventing the formation of the piston surface 125. Thus, the flapper member 150 will remain in the open position and the valve 100 will be locked in the open position. To lock the valve 100, the tube is typically pulled into the bore 110 from a position below the valve 100. In a similar manner, the valve 100 may be unlocked by removing the tube from the bore 110 of the valve 100.

In another embodiment, the valve may be used in a gas lift application to prevent the back flow of gas (or production fluid) as gas is injected into a string or strings of production tubing. In one example, gas lift valves are disposed at various locations along the length of an annulus formed between production tubing and well casing. Gas lift valves are well known in the art and are described in U.S. Pat. No. 6,932,581, which is incorporated by reference in its entirety herein. Pressurized gas is introduced into the annulus from the well surface and when some predetermined pressure differential exists between the annulus and the tubing at a certain location, that valve opens and the gas is injected into the tubing string to lighten the oil and facilitate its rise to the surface of the well. The control valve of the invention is used in conjunction with the gas lift valves to prevent a backflow of gas or fluid from the production tubing to the annulus. Typically, the control valve is located adjacent the gas lift valve in the annulus. The valve permits gas to flow into the gas lift valve when it is open. However, when the gas lift valve closes, the control valve, with its closing members restricts the flow of gas or fluid back toward the annulus.

In gas lift applications, control valves according to the invention may be fixed in a sidepocket mandrel. A conventional sidepocket mandrel has a pocket bore size of about 1.750 inches and the control valve dimensions are designed accordingly. Employing control valves according to the invention permits fluid path dimensions to be maximized. Thanks to the flapper sealing member, no flow restriction or significant pressure drop occurs across the valve, and a more efficient operation of the pump is possible. Moreover, control valves according to the invention prove more reliable because they do not present any erosion related problems like conventional check valves.

Figure 6:
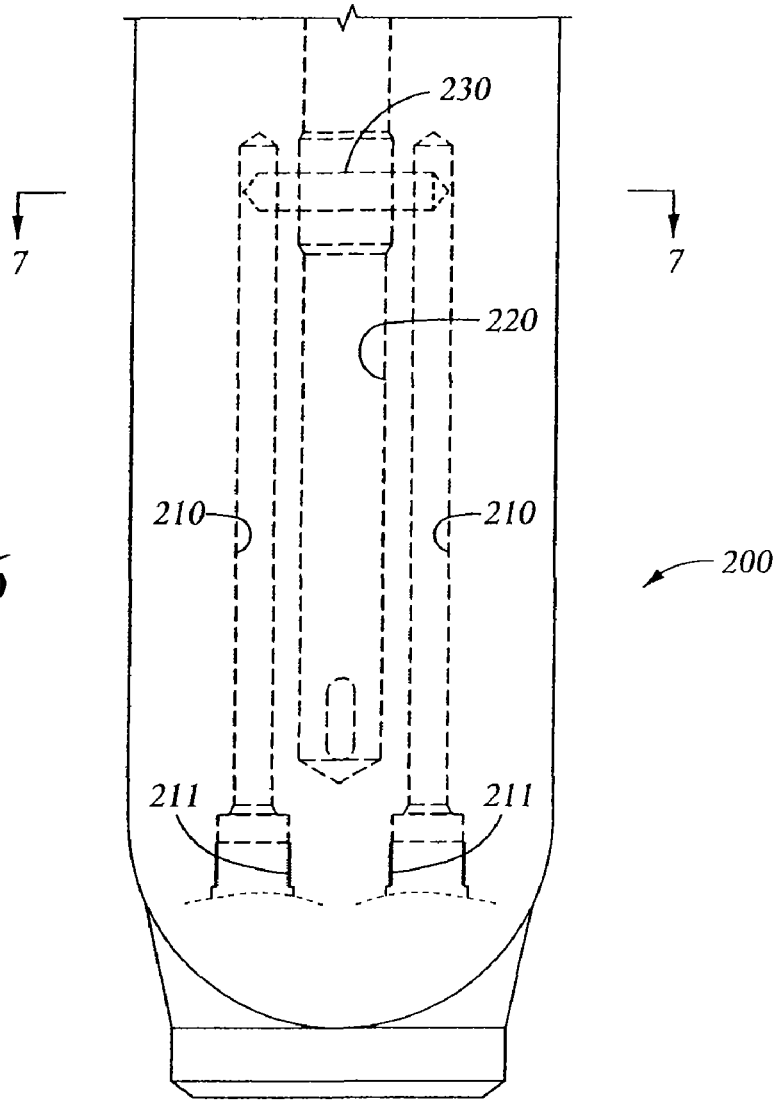
FIG. 6 is a view illustrating a sidepocket mandrel assembly for use in a gas lift well.
Figure 7:
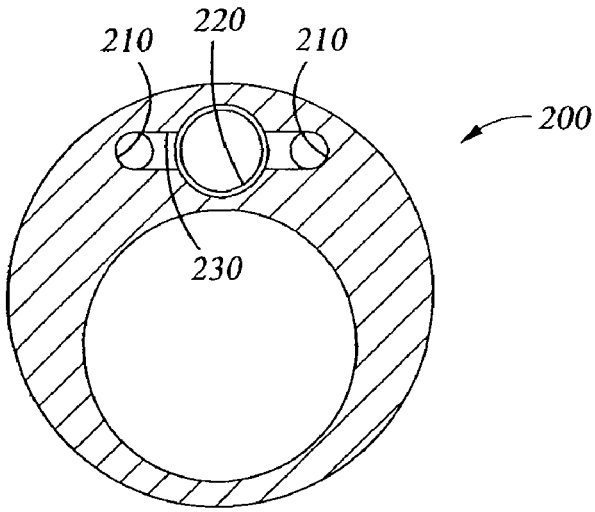
FIG. 7 is a view taken along line 7-7 of FIG. 6.

As illustrated in FIG. 6, in order to allow a larger amount of gas flowing into the tubing and optimizing the fluid flow path, a sidepocket mandrel 200 may be provided with two lateral bores 210 flowing into a main bore 220 which is connected in correspondence of its lower portion to the inside of the tubing string through a slot (not shown). The lateral bores 210 communicate with the main bore 220 through a drilled portion 230 which crosses the entire cross section of the main bore 220 and projects with its ends respectively into both the lateral bores 210. Each of the two lateral bores 210 in the sidepocket mandrel is provided with a seat 211 a control valve 100 (not shown) can be threadably connected thereto, whereas the main bore 220 is provided with a conventional gas lift valve (not shown). FIG. 7 illustrates a cross section of the sidepocket mandrel assembly in correspondence of the drilled portion 230.

A sidepocket mandrel as shown in FIGS. 6-7 is fixed to a tubing string located inside a wellbore and provided with control valves according to the invention in the respective seats 211. Pressurizing gas in the annulus between the tubing string and the wellbore and opening the gas lift valve at the same time, initiate gas flowing through the mandrel 200 into the tubing so that the control valves 100 are driven in an open condition, wherein the gas is permitted to flow through the mandrel 200 and exercise the necessary pressure to keep the control valves opened. Two different streams of gas are created respectively inside each lateral bore 210 which finally commingle inside the main bore 220. The gas then flows downwards inside the main bore 220 and finally enters the tubing string. The total amount of gas flowing through the mandrel 200 is directly dependent on the gas lift valve and, because in the opened condition the control valves do not cause any flow restriction, an optimization of the gas flow is obtained. Once the gas flow is either reduced or stopped the control valves close so as to prevent a backflow of gas or fluid from the production tubing to the annulus. The operation of the control valves according to the invention applied in gas lift applications is the same one as previously described in relation with FIGS. 2 to 5.

Although a sidepocket mandrel with two lateral bores has been described hereinabove, it is apparent that with regard to the object of the invention the same considerations here apply for a sidepocket mandrel including only one lateral bore.

Although the invention has been described in part by making detailed reference to specific embodiments, such detail is intended to be and will be understood to be instructional rather than restrictive. For instance, the valve may be used in an injection well for controlling the flow of fluid therein. It should be also noted that while embodiments of the invention disclosed herein are described in connection with a valve, the embodiments described herein may be used with any well completion equipment, such as a packer, a sliding sleeve, a landing nipple, and the like.

While the foregoing is directed to embodiments of the present invention, other and further embodiments of the invention may be devised without departing from the basic scope thereof, and the scope thereof is determined by the claims that follow.

The invention claimed is:

1. A valve for selectively closing a flow path through a wellbore in a first direction, the valve comprising:

a body;

a plurality of members configured to form a piston surface across the flow path, each member is attached via a pin member proximate an end of a shiftable member annularly disposed in the body, wherein each member rotates around an axis that extends through a length of the pin member from an opened position to a closed position towards a centerline of the body to form the piston surface; and a flapper member, the flapper member closable to seal the flow path when the shiftable member moves from a first position to a second position due to fluid flow acting on the piston surface, wherein the shiftable member in the first position blocks the flapper member from closing and wherein the shiftable member is biased in the first position by a biasing member disposed between the body and the shiftable member.

2. The valve of claim 1, wherein the plurality of members are positioned in the body at a location below the flapper member.

3. The valve of claim 1, wherein each member is annularly disposed within the shiftable member.

4. The valve of claim 1, wherein each member is biased inward toward the centerline of the body.

5. The valve of claim 1, wherein each member rotates around the pin in a first direction when the fluid flow is reduced in a second direction.

6. The valve of claim 1, wherein the flapper member is movable between an open position and a closed position.

7. The valve of claim 6, wherein the shiftable member retains the flapper member in the open position when the shiftable member is in the first position.

8. The valve of claim 1, wherein the piston surface is coated with an abrasion resistant material.

9. The valve of claim 1, wherein the biasing member is a spring.

10. The valve of claim 1, wherein the shiftable member includes a plurality of recessed pockets configured to house the plurality of members within the shiftable member when the plurality of members are in the opened position.

11. The valve of claim 1, wherein the plurality of members in the opened position have an inner diameter at least as large as an inner diameter of a bore formed in the body.

12. A valve for selectively closing a flow path through a wellbore in a single direction, the valve comprising:

a housing;

a plurality of members configured to form a variable piston surface area across the flow path;

a flow tube axially movable within the housing between a first and a second position due to fluid flow acting on the variable piston surface, wherein each member in the variable piston surface is attached to the flow tube via a connection member and is rotatable around a circumference of the connection member toward a centerline of the housing to form the variable piston surface area;

a flapper for closing the flow path through the valve upon movement of the flow tube to the second position, wherein the flow tube substantially prevents the flapper from closing the flow path when the flow tube is in the first position; and a biasing member having a first portion attached to the housing and a second portion attached to the flow tube, wherein the biasing member is configured to bias the flow tube in the first position.

13. The valve of claim 12, wherein the flow tube has an enlarged end with a plurality of recessed sections configured to receive the plurality of members within the flow tube when the plurality of members are in an opened position.

14. The valve of claim 12, wherein each member is movable between an opened position having a smaller surface area across the flow path and a closed position having a larger surface area across the flow path.

15. The valve of claim 14, wherein each member is biased in the closed position.

16. The valve of claim 12, wherein each member rotates around the connection member in a single direction when the fluid flow is reduced in a direction opposite the single direction.

17. A method of operating a gas lift well, comprising:

pressurizing an annular area with gas, the annular area being formed between a production tubing string and a wellbore;

opening a gas lift valve located in the annulus, the gas lift valve permitting the flow of gas from the annulus to an interior of the production tubing;

closing the gas lift valve;

closing a second valve, the second valve having:

a body;

a plurality of members configured to form a piston surface across a flow path through the body, each member is attached via a pin member to an end of a shiftable member annularly disposed in the body wherein each member rotates around a circumference of the pin member towards a centerline of the body to form the piston surface; and a flapper member, the flapper member closable to seal the flow path when the shiftable member moves from a first position to a second position due to fluid flow acting on the piston surface, wherein the shiftable member blocks the flapper member from closing when the shiftable member is in the first position and wherein the shiftable member is biased in the first position by a biasing member disposed between the body and the shiftable member.

18. The method of claim 17, further including re-opening the second valve.

19. The method of claim 17, further including a plurality of gas lift valves and a plurality of second valves disposed axially along the annulus.

20. The method of claim 17, wherein the gas lift valve is opened due to a predetermined pressure differential between the annulus and the interior of the production tubing.

21. The method of claim 17, wherein the piston surface is formable due to a change in flow between the annulus and the production tubing.

22. An assembly for selectively closing in a single direction a flow path between an annular area and the inside of a production tubing string, wherein the annular area is formed between the production tubing string and a wellbore, the assembly comprising:

a mandrel provided with at least one bore communicating at one end with the outside of the tubing string and at another end with the inside of the tubing string;

a valve for selectively closing a flow path in a single direction, the valve comprising a housing connected to the mandrel, a plurality of members configured to form a variable piston surface area across the flow path, a flow tube axially movable within the housing between a first and a second position due to fluid flow acting on the variable piston surface area, wherein each member in the variable piston surface is attached to the flow tube via a connection member and is rotatable around an axis that extends through a length of the connection member from an opened position to a closed position toward a centerline of the housing to form the variable piston surface area, and a flapper for closing the flow path through the valve upon movement of the flow tube to the second position, wherein the flow tube substantially prevents the flapper from closing the flow path when the flow tube is in the first position and wherein a biasing member is configured to bias the flow tube in the first position; and a gas lift valve, wherein the gas lift valve communicates with the flow tube through the flapper.

23. The assembly of claim 22, wherein the mandrel is a sidepocket mandrel.

24. A valve for selectively closing a flow path through a wellbore, the valve comprising:

a housing;

a flow tube axially movable in the housing between an open position and a close position, wherein the flow tube is biased in the open position by a biasing member having a portion disposed between the housing and the flow tube;

a plurality of piston members configured to form a variable piston surface area in the flow path, wherein each piston member is pivotally attached to the flow tube and is operable to move the flow tube between the open position and the close position in response to a fluid flow in the flow path; and a flapper for closing the flow path through the valve upon movement of the flow tube to the close position, wherein the flow tube in the close position allows the flapper to close the flow path.

25. The valve of claim 24, wherein a size of the variable piston surface changes in response to the fluid flow.

26. The valve of claim 25, wherein fluid flow in one direction causes the plurality of piston members to form a larger piston surface area than fluid flow in another direction.

* * * * *